US007241138B2

(12) United States Patent
Flohr et al.

(10) Patent No.: US 7,241,138 B2
(45) Date of Patent: Jul. 10, 2007

(54) BURNER WITH STEPPED FUEL INJECTION

(75) Inventors: Peter Flohr, Birmenstorf (CH); Christian Oliver Paschereit, Berlin (DE)

(73) Assignee: ALSTOM Technology Ltd., Baden (CH)

( * ) Notice: Subject to any disclaimer, the term of this patent is extended or adjusted under 35 U.S.C. 154(b) by 251 days.

(21) Appl. No.: 10/874,161

(22) Filed: Jun. 24, 2004
(Under 37 CFR 1.47)

(65) Prior Publication Data

US 2006/0154192 A1 Jul. 13, 2006

Related U.S. Application Data

(63) Continuation of application No. PCT/CH02/00714, filed on Dec. 19, 2002.

(30) Foreign Application Priority Data

Dec. 24, 2001 (DE) ..... 101 64 099

(51) Int. Cl.
*F23D 14/62* (2006.01)
*F23C 5/00* (2006.01)

(52) U.S. Cl. ..... 431/350; 431/354; 431/174; 431/114; 431/8

(58) Field of Classification Search ..... 431/353, 431/350, 351, 354, 114, 174, 173, 177, 8, 431/9, 10, 12; 60/737, 746, 725
See application file for complete search history.

(56) References Cited

U.S. PATENT DOCUMENTS 4,761,958 A * 8/1988 Hellat ..... 60/737

(Continued)

FOREIGN PATENT DOCUMENTS

DE 19545310 6/1997

(Continued)

OTHER PUBLICATIONS

Paschereit, C. O., et al., "Structure and Control of Thermoacoustic Instabilities in a Gas-turbine Combustor," Combust. Sci. and Tech. 1998, 213-232, vol. 138, OPA (Overseas Publishers Association) N.V., Malaysia.

(Continued)

*Primary Examiner*—Josiah C. Cocks
(74) *Attorney, Agent, or Firm*—Cermak & Kenealy, LLP; Adam J. Cermak

(57) ABSTRACT

In a burner (1) having an interior space (22) surrounded by at least one shell (8, 9) in which burner (1) fuel is injected through fuel nozzles (6) arranged at the burner shells (8, 9) into a combustion air stream (23) flowing within the interior space (22), the fuel/air mix which is formed flows to a flame front (3) in a combustion chamber (2) within a delay time ($\tau$), where it is ignited, the formation of combustion-driven thermoacoustic oscillations is avoided by virtue of the fact that means (24), which allow fuel to be injected into the combustion air stream (23) via at least two fuel injection holes (25) distributed over the length of the means (24) are arranged so as to project from the burner base (27) into the interior space (22) substantially in the direction of the combustion chamber (2), so that the delay time ($\tau$) between injection of the fuel and its combustion at the flame front (3) corresponds to a distribution (12) which avoids combustion-driven oscillations in premix operation.

22 Claims, 5 Drawing Sheets

U.S. PATENT DOCUMENTS

| | | | | |
|---|---|---|---|---|
| 5,375,995 | A * | 12/1994 | Dobbeling et al. | 431/8 |
| 5,482,457 | A * | 1/1996 | Aigner et al. | 431/351 |
| 5,943,866 | A * | 8/1999 | Lovett et al. | 60/737 |
| 6,270,337 | B1 | 8/2001 | Etemad et al. | |
| 6,705,857 | B2 * | 3/2004 | Paschereit et al. | 431/350 |

FOREIGN PATENT DOCUMENTS

| | | | |
|---|---|---|---|
| DE | 19809364 | | 9/1998 |
| DE | 10029607 | | 12/2001 |
| EP | 0210462 | | 2/1987 |
| EP | 0321809 | | 12/1988 |
| EP | 0627062 | | 12/1994 |
| EP | 0704657 | | 4/1996 |
| EP | 0 713 058 | A1 * | 5/1996 |
| EP | 0778445 | | 6/1997 |
| EP | 0780629 | | 6/1997 |
| EP | 0833105 | | 4/1998 |
| EP | 0881432 | | 12/1998 |
| EP | 0918152 | | 5/1999 |
| EP | 0999367 | | 5/2000 |
| EP | 1001214 | | 5/2000 |
| WO | WO93/17279 | | 9/1993 |
| WO | WO98/12478 | | 3/1998 |
| WO | 1 001 214 | A1 * | 11/1998 |
| WO | WO01/96785 | | 12/2001 |
| WO | WO02/052201 | | 7/2002 |
| WO | WO 02/052201 | A1 * | 7/2002 |
| WO | WO03/056241 | | 7/2003 |

OTHER PUBLICATIONS

Search Report for German Patent App. No. 101 64 099.4 (Aug. 2, 2002).

Search Report for PCT Patent App. No. PCT/CH02/00714 (Feb. 24, 2003).

International Preliminary Examination Report for PCT Patent App. No. PCT/CH02/00714 (Sep. 2, 2003).

* cited by examiner

BURNER WITH STEPPED FUEL INJECTION

This application is a Continuation of, and claims priority under 35 U.S.C. § 120 to, International application number PCT/CH02/00714, filed 19 Dec. 2002, and under 35 U.S.C. § 119 to German application number 101 64 099.4, filed 24 Dec. 2001, the entireties of both of which are incorporated by reference herein.

BACKGROUND OF THE INVENTION

1. Field of the Invention

The present invention relates to a burner and to a method for operating a premix burner.

2. Brief Description of the Related Art

What are known as thermoacoustic fluctuations often occur in burners which supply liquid or gaseous fuel to a combustion chamber where the fuel burns at a flame front. This is true in particular if the burners are operated with high air ratio, for example, although not exclusively, in the case of what is known as the double-cone burner, as described EP-B1 0 321 809, which has been used with great success. Thermoacoustic vibrations of this nature also occur in the case of premix burners with a downstream mixing section, as described, for example, in EP-A2 0 704 657. In addition to the flow stability, mixing ratio fluctuations represent a primary reason for the occurrence of thermoacoustic instability of this nature. Flow instability waves which occur at the burner lead to the formation of turbulence (coherent structures), which can influence combustion and lead to periodic release of heat, with the associated fluctuations in pressure. The fluctuating air column in the burner leads to fluctuations in the mixing ratio, with the associated fluctuations in the release of heat. Moreover, fluctuations of this nature may also be caused by alternating flame front positions.

A further mechanism for exciting thermoacoustic oscillations is provided if, with a correct phase position (what is known as the Rayleigh criterion has to be satisfied, cf. below), local fluctuations in the release of heat are coupled with fluctuations in the mixing ratio via the fluctuating air column in the burner.

In burners of this type, there are often a plurality of fuel injection nozzles which are arranged in groups in order in this way to ensure stable combustion in different load ranges, for example special pilot nozzles for the lower load range. In this case, the flame position may shift significantly depending on the type of pilot control, and in such a case thermoacoustic fluctuations may also occur in transition regions as a result of a periodic change in the flame front positions.

These thermoacoustic oscillations pose a risk to any type of combustion application. They lead to high-amplitude pressure oscillations, to restrictions to the operating range and may also increase the emissions of pollutants. This applies in particular to combustion systems with little acoustic damping, such as for example annular combustion chambers with reverberant walls. In order to allow a high level of power conversion with regard to pulsations and emissions over a wide operating range, active control of the combustion oscillations may be required.

Coherent structures play a crucial role in mixing processes between air and fuel. The dynamics of these structures accordingly influence combustion and therefore the release of heat. Influencing the shear layer between the fresh-gas mix and the recirculating exhaust gas allows the combustion instabilities to be controlled. One possibility in this respect is acoustic excitation, as known from EP-A1 0 918 152.

Fuel staging allows the flame position to be influenced and therefore the influence of flow instabilities and time delay effects to be reduced (as described for example in EP-A1 0 999 367).

A further mechanism which can give rise to thermoacoustic oscillations is fluctuations in the mixing ratio between fuel and air.

The document WO-A1-01/96785 relates to a burner consisting of a torsion generator for a combustion air current, a torsion chamber, and means of introducing fuel to the combustion air current, whereby the torsion generator exhibits entrance openings to admit air for the combustion air current, which enters the torsion chamber tangentially, and the means for introducing fuel to the combustion air current comprise at least an initial fuel intake with an initial group of fuel outlet openings arranged substantially in the direction of a burner axis for an initial quantity of premixed fuel. Furthermore, one or more second fuel intake(s), with a second group of fuel outlet openings, arranged substantially in the direction of the burner axis, is/are provided for a second quantity of premixed fuel, whereby the second fuel intake(s) can admit the fuel, independent of the first fuel intake. With the present burner, optimal mixing conditions can be set, even in cases of divers loads, gas qualities, or gas pre-heating temperatures.

The patent application DE-A 1-195 45 310, which was laid open to public inspection, reveals a pre-mixing burner for the purpose of mixing fuel and combustion air prior to ignition, whereby the burner consists, substantially, of at least two partially conical shells, with pertinent partially conical axes and entry channels for the combustion air. The premixing burner is substantially formed of a straight hollow cone, which is delimited by an external conical mantle and an internal conical mantle, in which, in addition, at least two entry channels are arranged tangentially to the inner conical mantle, and along a straight conical mantle line of the conical mantle. The partially conical axes of the partially conical shells formed as a result lie on a common conical axis.

SUMMARY OF THE INVENTION

Accordingly, the invention is based on the object of providing a burner and a method for operating a burner in which the occurrence of thermoacoustic oscillations of this nature is reduced or even avoided.

This is a burner with an interior space surrounded by at least one shell, in which burner fuel is injected, through fuel nozzles arranged at the burner shells, into a combustion air stream flowing within the interior space, the fuel/air mix which is formed flows, within a delay time, to a flame front in a combustion chamber, where it is ignited.

According to the invention, in a burner of this type thermoacoustic oscillations are reduced or even avoided altogether by virtue of means, which allow fuel to be injected into the combustion air stream via at least two fuel injection holes distributed over the length of the means, being arranged so as to project from the burner base into the interior space substantially in the direction of the combustion chamber, so that the delay time between injection of the fuel and its combustion at the flame front corresponds to a distribution, in particular a systematically varying distribution, which avoids combustion-driven oscillations in premix operation. The fuel injected may be liquid or gaseous fuel.

Experience has shown that in a conventional burner the delay time $\tau$ between the location of injection and effective combustion at the flame front is substantially equal for all the fuel nozzles distributed over the burner length. There is a slight variation, which is not systematic with respect to the injection position, about a mean. The result of this is that thermoacoustic oscillations can easily build up. The core of the invention therefore consists in injecting the fuel into the combustion air stream via means arranged in the interior space in such a manner that the delay time $\tau$ between injection location and effective combustion at the flame front is not substantially equal for all the fuel nozzles distributed over the burner length, but rather adopts a distribution which varies, in particular systematically, over the burner length.

A first preferred embodiment of the burner is distinguished by the fact that the means are a fuel lance which is arranged substantially on the axis of the burner and which in particular has fuel injection holes along its surface. In this context, it is preferable for the fuel lance to be substantially cylindrical in cross section, with the fuel injection holes being distributed both with regard to the length of the fuel lance and with regard to their circumferential arrangement on the fuel lance. In this case, given a suitable selection of the location of injection and of the fuel penetration depth, it is possible to set the delay time scatter virtually arbitrarily, so that it is possible to feed different flow lines. This central tube, which projects into the interior space and may be formed, for example, from tubes which are nested coaxially inside one another, allows simple and efficient stepped injection to be carried out. If coaxially nested tubes are used, it is possible, for example, for the pilot fuel (gaseous or liquid) to be supplied in the central tube, having the smallest diameter, since a pilot nozzle is typically arranged at the tip of the lance, and for the fuel which is to be injected into the interior space through the fuel injection holes during premix operation to be arranged in the outermost space between the tube having the largest diameter and the next tube in. In other words, it is advantageously possible for the pilot lance, which is often already present and is provided for pilot operation of the burner, after slight modification, to be used as a fuel lance to inject fuel in a stepped fashion during premix operation. A lengthened pilot lance, as described, for example, in EP-A2 0 778 445 for the case of a double-cone burner and in WO 93/17279 and EP-A2 0 833 105 for premix burners without and with a downstream mixing section, respectively, is particularly suitable for this purpose.

According to a further preferred embodiment of the present invention, the length of the means which projects into the interior space is in the range from half the length to the full length of the premix section of the burner. The length of the fuel lance is mainly limited by the length from the lance base to the flame position in the combustion chamber in premix operation. The further the fuel lance projects into the interior space of the burner, the greater the distributions in the delay time it is possible to achieve. The more fuel that it is possible to introduce into the combustion air stream in a manner which is distributed over the fuel lance in relation to the fuel injected, for example, at air inlet slots, the more efficiently it is possible to prevent thermoacoustic oscillations.

According to a further preferred embodiment, the burner is a cone burner, in particular a double-cone burner, which is formed from at least two hollow part-cone bodies which are positioned with respect to one another, have a cone inclination which increases in the direction of flow and are arranged offset with respect to one another, so that the combustion air flows into the interior space through a gap between the part-cone bodies. In other words, the concept of the invention can be employed in burners as described, for example, in EP-B1 0 321 809, EP-A2 0 881 432 or, in very general form, in EP-A1 0 210 462. With regard to the design and geometry of a double-cone burner, the subject matter of the three abovementioned European patents is to be explicitly incorporated in the content of disclosure of the present invention.

According to another preferred embodiment, the burner is a four-slot burner which in particular has a mixing section arranged downstream of the four-slot burner. In other words, the concept of the invention can be employed in a burner as described, for example, in EP-A2 0 704 657 or in EP-A2 0 780 629. The subject matter of these two abovementioned European patents is also to be explicitly incorporated in the content of disclosure of the present invention with regard to the design and geometry of a cone burner with a downstream mixing section.

Another embodiment of the burner is characterized in that the fuel injection holes are divided into groups, with in each case one group of fuel injection holes being arranged in such a manner that all the nozzles belonging to the group feed a defined region of the flame front, with a differing time delay. It is typically possible, for example, to provide a total of 2n fuel injection holes at the means, with these fuel injection holes divided in particular into n groups of in each case 2 nozzles so that they can be actuated as individual groups.

Moreover, the present invention relates to a method for feeding fuel into a burner, which burner comprises an interior space surrounded by at least one shell, in which fuel is injected through fuel nozzles into a combustion air stream flowing within the interior space, and the fuel/air mix which is formed flows, within a delay time, to a flame front in a combustion chamber, where it is ignited. The method is distinguished by the fact that the fuel is injected at least in part by means of means which allow fuel to be injected into the combustion air stream via at least two fuel injection holes distributed over the length of the means and which project from the burner base into the interior space substantially in the direction of the combustion chamber, so that the delay time between injection of the fuel and its combustion at the flame front corresponds to a distribution which avoids combustion-driven oscillations in premix operation. In this context, the maximum time delay ($\tau_{max}$) between location of injection and flame front is typically in the range of $\tau_{max}$=5-50 ms, and with a fuel/air mix flow velocity in the interior space in the range from 20-50 m/s, the maximum time delay ($\tau_{max}$) is in the range of $\tau_{max}$=5-15 ms.

According to a first preferred embodiment of the method according to the invention, the fuel is injected in such a manner that the time delay distribution is configured so as to decrease substantially linearly over the burner length toward the burner end, from the maximum value $\tau_{max}$, decreasing by a maximum delay difference $\Delta\tau$, to a minimum value at the burner end of $\tau_{max}-\Delta\tau$. It is preferable for the delay difference $\Delta\tau$ to be in the range from 10-90% of the maximum value $\tau_{max}$, in particular in the range of more than 50% of the maximum value $\tau_{max}$.

BRIEF DESCRIPTION OF THE DRAWINGS

The invention is to be explained in more detail below on the basis of exemplary embodiments in conjunction with the drawings, in which.

Only the elements which are of relevance to the invention are illustrated. Identical elements are denoted by identical reference symbols throughout the various figures.

DETAILED DESCRIPTION OF THE PREFERRED EMBODIMENTS

If the time delay between the fuel injection and the periodic release of heat, i.e. the flame front, is influenced, it is possible to control the combustion instability. The basic idea of the invention is to disrupt the time delay $\tau$ between the periodic release of heat at the flame front and the pressure fluctuation during injection, so that the Rayleigh criterion $$G(x) = \frac{1}{T}\int_0^T p'(x,t)\,q'(x,t)\,dt < 0$$

is no longer satisfied, i.e. release of heat and pressure maximum are no longer in phase. This eliminates a primary driving mechanism in the excitation of thermoacoustic oscillations, since otherwise, with a corresponding time delay or corresponding phase position, the pressure fluctuations at the fuel injection can lead to variations in the mixing ratio and therefore to a fluctuating release of heat. Presenting the Rayleigh criterion after a Fourier transform in the frequency range demonstrates this relationship even more clearly:

$$G(x)=2\int|S_{pq}(x,f)|\cos(\phi_{pq})\,df$$

where $S_{pq}(x,f)$ represents the cross spectrum between pressure fluctuations $p'(x,t)$ and fluctuations in the release of heat $q'(x,t)$ and $\phi_{pq}$ represents the phase difference. Selecting the correct phase difference between release of heat (which can be influenced by the time delay) and the pressure signal allows the Rayleigh index to be set to $G(x)<0$, so that the system is damped.

Figure 1A:
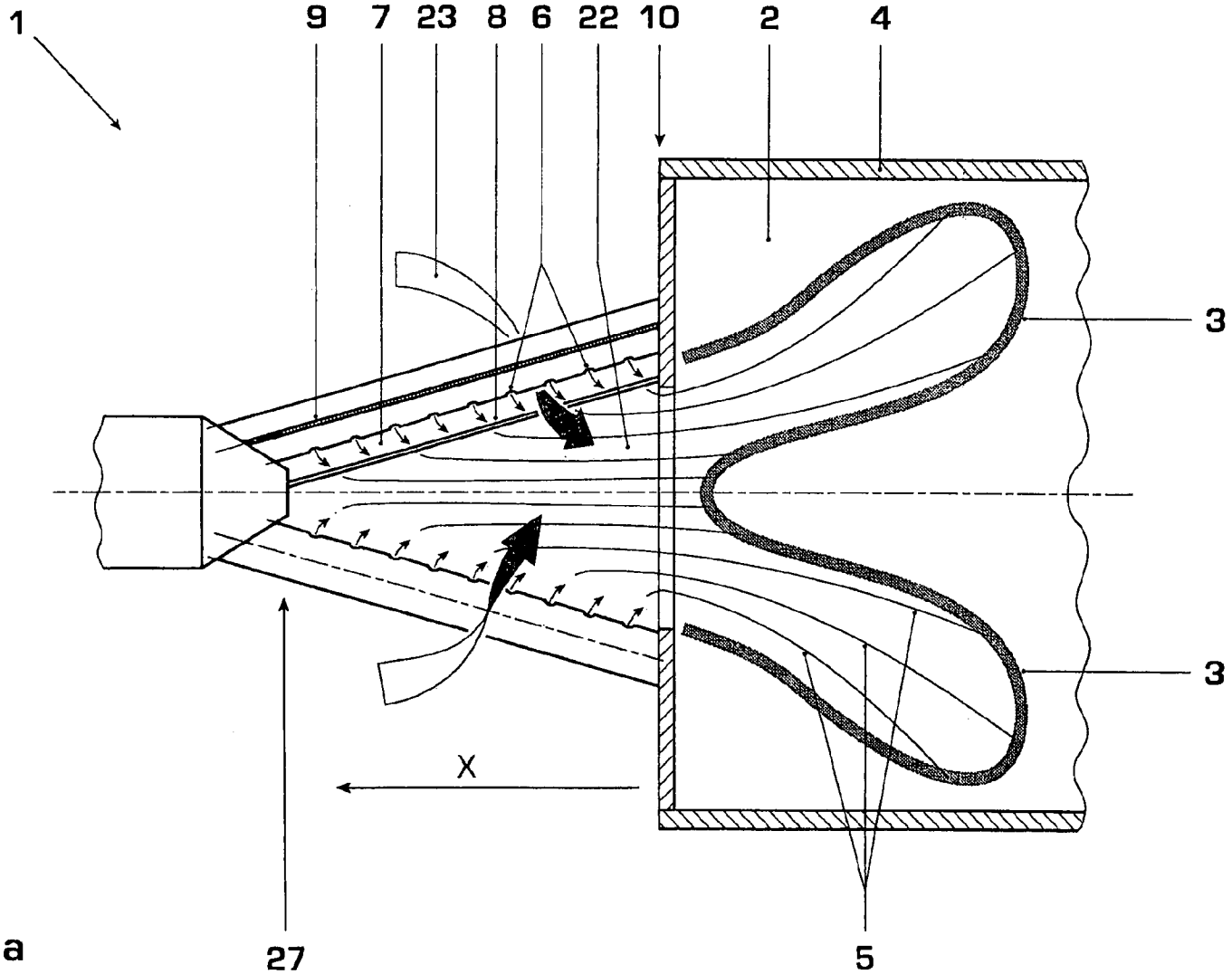
FIG. 1*a* shows a conventional double-cone burner with typical fuel injection.

It has now been found that the time delay from the injection location at the fuel nozzles to the flame front, in the case of existing premix burners, is constant at defined operating points over the entire injection length of the premix gas, as for example in the case of a double-cone burner in accordance with the prior art as illustrated in FIG. 1*a*.

In this longitudinal section through a double-cone burner 1, which is to be understood as representing an example, as known, for example, from EP 0 321 809, the upper gap 7 between the two conical burner shells 8 and 9 can be seen. The combustion air 23 passes through this gap 7, past the fuel nozzles 6 distributed over the burner length, into the interior space 22, with the fuel being captured and surrounded by the air 23 flowing past. In the interior space 22 of the burner 1, the combustion air stream flows along the flow lines 5 so as to form a conical fuel column which widens in the direction of flow. The fuel/air mix then passes into the combustion chamber 2, where it ignites at a flame front 3. The flow in the burner interior space 22 up to the flame front 3 in this case follows the flow lines as illustrated in FIG. 1*a*.

Figure 1B:
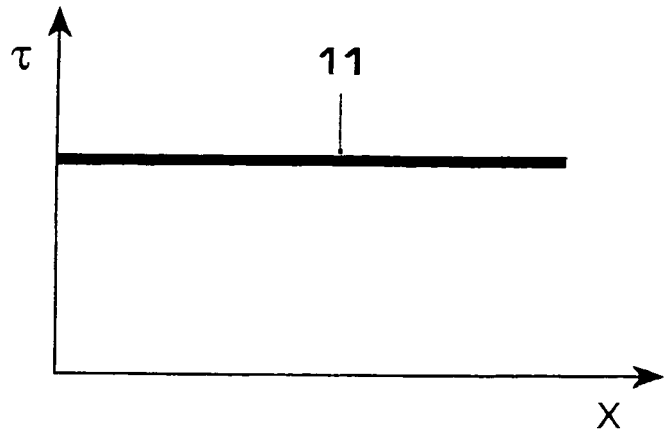
FIG. 1*b* shows the schematic delay time distribution over the burner length which occurs with a burner as shown in FIG. 1*a;*

In the case of a double-cone burner of this type, the delay time $\tau$ which elapses between the injection at the fuel nozzles 6 and the ignition at the flame front 3 is virtually constant for all positions of the fuel nozzles, as is diagrammatically illustrated in FIG. 1*b* (coordinate x in this case extends from the exit 10 of the burner 1 to its rear end, i.e. to the burner base 27, i.e. from the right to the left in FIG. 1*a*). In other words, it is impossible to observe any systematic variation in the delay times $\tau$ as a function of the fuel nozzle position along the burner 1 (for example shorter delay times for nozzles 6 close to the burner outlet 10), but rather the distribution appears to be more or less random, fluctuating only slightly about a mean, as a function of the injection location x.

Figure 2:
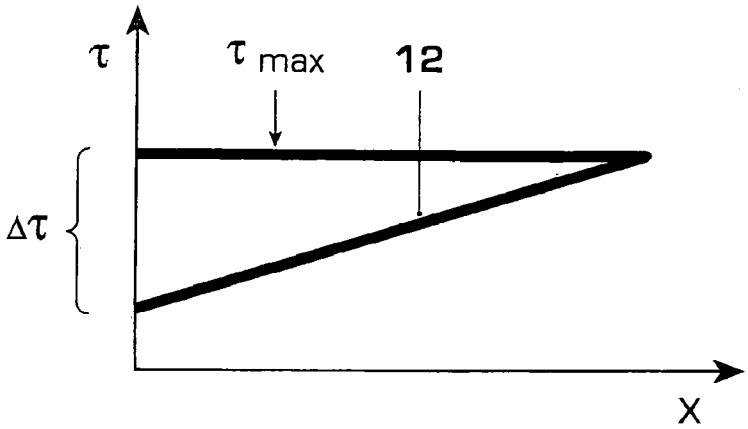
FIG. 2 shows a linear delay time distribution.

As illustrated in FIG. 2, it is now proposed, according to the invention, to set a distribution of the delay time over the burner length instead of the hitherto substantially constant time delay from the fuel injection 6 to the flame front 3. The first choice is for the distribution to be set in such a way that the delay times $\tau$ vary linearly by a delay time difference $\Delta\tau$, specifically increasing linearly from a minimum $\tau_{max}-\Delta\tau$ to the maximum in the rear burner region of $\tau_{max}$.

Figure 3:
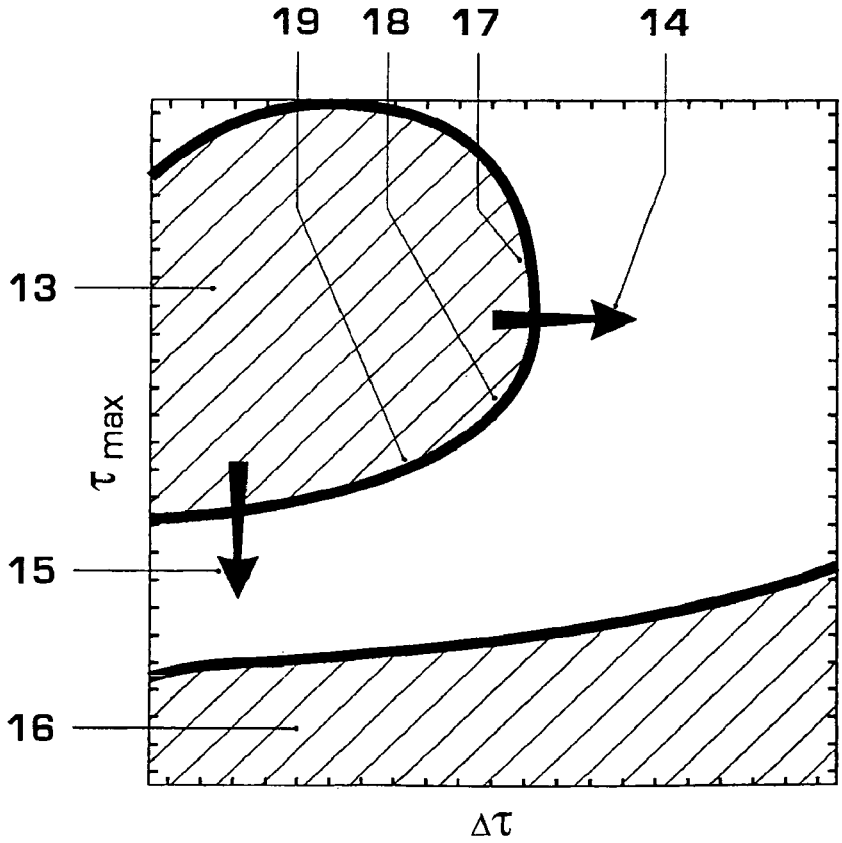
FIG. 3 shows a two-dimensional stability analysis for delay time distributions.

FIG. 3 provides a two-dimensional illustration of the burner stability as a function of the parameters $\Delta\tau$(x axis) and $\tau_{max}$(y axis) for a delay time distribution as indicated in FIG. 1. In principle, it can be seen that both changes in the maximum value and variations in the delay time scatter can have a considerable influence on the stability of the burner. Three values of the characteristics at various flow velocities in the burner are given as individual examples of measured values: for low flow velocity 17, for medium flow velocity 18 and for high flow velocity 19. In general, it has been found that two fundamentally unstable regions, which are hatched in FIG. 3, are formed. Firstly, there is an unstable region 16 of short delay times. Here, the burner is acoustically unstable for such high flow velocities virtually irrespective of the choice of $\Delta\tau$. A second, insular region 13 with unstable characteristics is to be found for low velocities, i.e. high values of $\tau_{max}$, and for low values of $\Delta\tau$.

In principle, it can be recognized that the stability of a burner which is operating with its typical operating values generally close to the island 13 can be stabilized both by increasing the flow velocity in the direction indicated by arrow 15 and by increasing the delay time difference $\Delta\tau$, i.e. by shifting the operating point to the right in the graph shown, as indicated by arrow 14. Since, for practical reasons, the value of $\tau_{max}$ cannot always easily be shifted in the stable low range indicated by 15 (cf. below), a shift produced by setting higher delay time differences $\Delta\tau$, i.e. more extensively spread delay times, is often an efficient and practicable alternative. The operating point for operation of a gas turbine at base load is typically at the point 19 indicated in FIG. 3. This point lies in the boundary region between stable and unstable combustion and can in principle be stabilized both by variations in the maximum value and by a change in the scatter. Variations in the maximum value are generally associated with different flow velocities in the burner, i.e. with power variations. These are generally produced through operation of the gas turbine and can often be difficult to influence in existing designs of gas turbines.

The delay times for burners are typically in the range from $\tau$=5-50 ms, and in the case of double-cone burners are normally in the range from 5-15 ms at flow velocities of 10-50 m/s. In the case of four-slot burners with downstream mixing section, the delay times are normally in the range from 5-50 ms at flow velocities of 10-100 m/s. $\Delta\tau$ can now be varied within a wide range; variations of $\Delta\tau=0.5\ \tau_{max}$ or above have typically proven particularly advantageous, both in the case of double-cone burners and in the case of four-slot burners with downstream mixing section.

Figure 4:
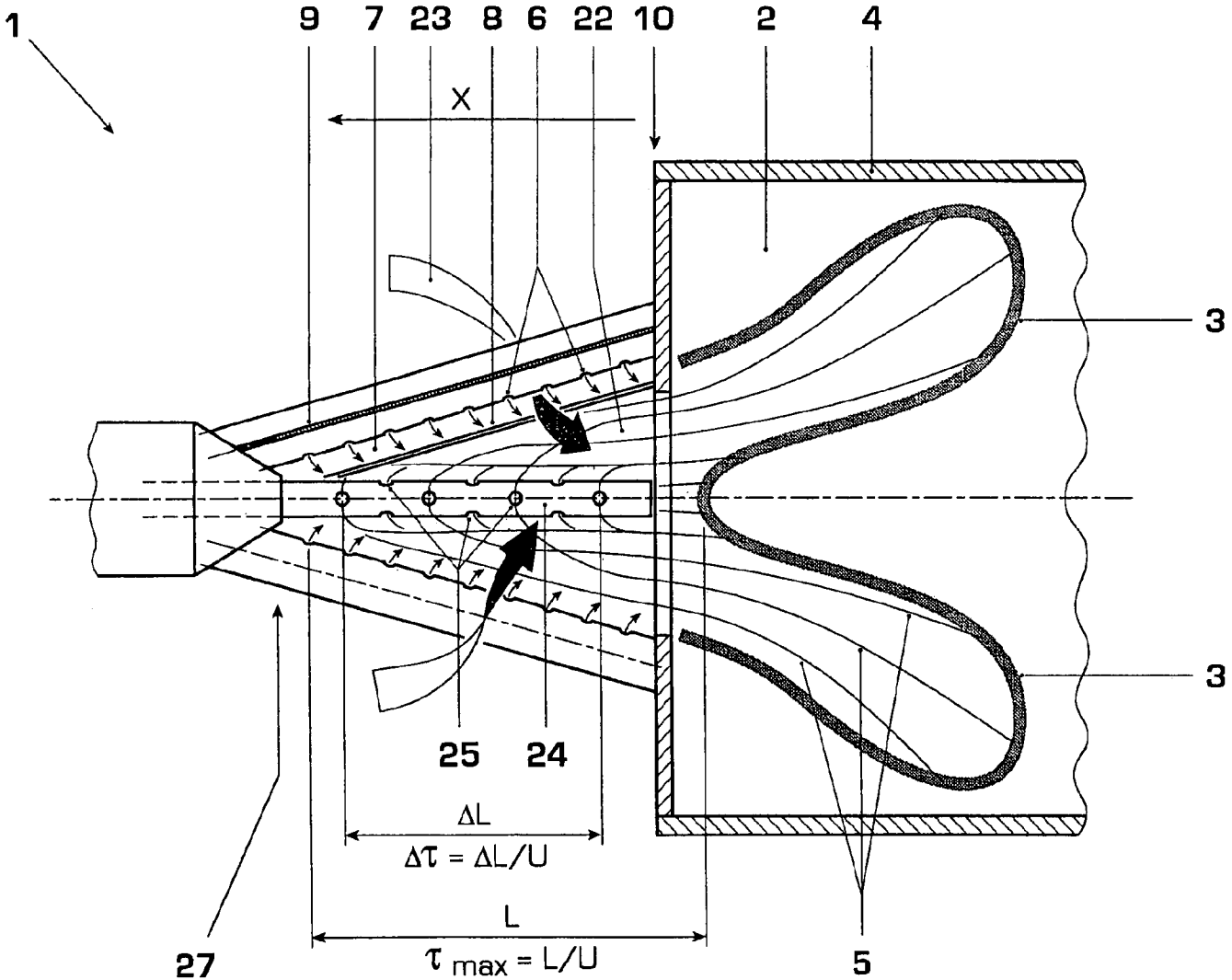
FIG. 4 shows a double-cone burner with means for injecting fuel arranged in the interior space of the burner.

A distribution of this nature at a double-cone burner as already illustrated in FIG. 1, serving as an exemplary embodiment, can in technical terms be realized by injection of fuel into the combustion air stream 23 by means of a fuel lance 24, as illustrated in FIG. 4. Starting from the burner base 27, the fuel lance 24 projects into the interior space 22 of the double-cone burner 1. The fuel lance is substantially arranged on the axis of the double-cone burner 1, is cylindrical in shape and has fuel injection holes 25 distributed over its radial surface. The fuel injection holes 25 are distributed over the length of the fuel lance 24. Moreover, the holes 25 are also distributed over the circumference, either in the form of rings or, as illustrated in FIG. 4, in offset form. In this case, given a suitable selection of the location of injection and of the fuel injection depth, it is possible to set virtually any desired delay time scatter. It is also possible to feed different flow lines 5 within the burner 1. The maximum delay time $\tau_{max}$ occurring in a burner 1 of this type is produced, as indicated in FIG. 4, by the ratio of the maximum distance L between fuel injection and flame front 3 to the flow velocity U in the burner. The maximum distance L is in this case usually the distance between the fuel nozzle 6 arranged closest to the burner base 27 and the flame front 3. If one considers fuel which is injected into the combustion air stream 23 via the fuel injection holes 25 of the fuel lance 24, it will be found that a time delay $\Delta\tau$ is produced over the distance between two fuel injection holes 25 which corresponds to the ratio of the distance $\Delta L$ between two fuel injection holes 25 to the flow velocity U of the combustion air stream 23 in the burner 1 ($\Delta\tau=\Delta L/U$). In this way, it is possible to set the desired distribution profile 12 by means of the distribution of the holes 25. In this context, it is desirable in particular to achieve a scatter in the delay time which reaches or exceeds half the maximum value, $\Delta\tau\geqq 0.5\ \tau_{max}$. Depending on the extent to which thermoacoustic oscillations effectively constitute a problem for a specific operating state, it is in this case possible to set and control the ratio of fuel injected via fuel nozzles 6 at the air inlet slots 7 to fuel injected via the fuel injection holes 25 according to the specific situation. In any event, it is provided that the fuel injected via the fuel lance 24 at least partially replaces the fuel which is injected via the fuel nozzles 6.

The maximum scatter $\Delta\tau$ has proven particularly important with a view to preventing thermoacoustic oscillations, whereas the distribution function of $\tau$ in general plays more of a subordinate role. Even a small proportion, in the range from 5-30%, of the total fuel mass flow which is injected via the lance may be sufficient to stabilize the flame by virtue of the scatter.

The maximum range over which a distribution 12 can be set is in this case substantially predetermined by the length of the fuel lance 24. Satisfactory results with regard to the avoidance of thermoacoustic oscillations can be achieved with fuel lances 24 which extend at least half way into the conical section of the burner, but it is preferable for the lance 24 to be longer, extending over ¾ of the length of the burner or even over the entire length of the burner. In principle, the lance may extend as far as the location at which the flame front 3 is located in premix operation.

Figure 6:
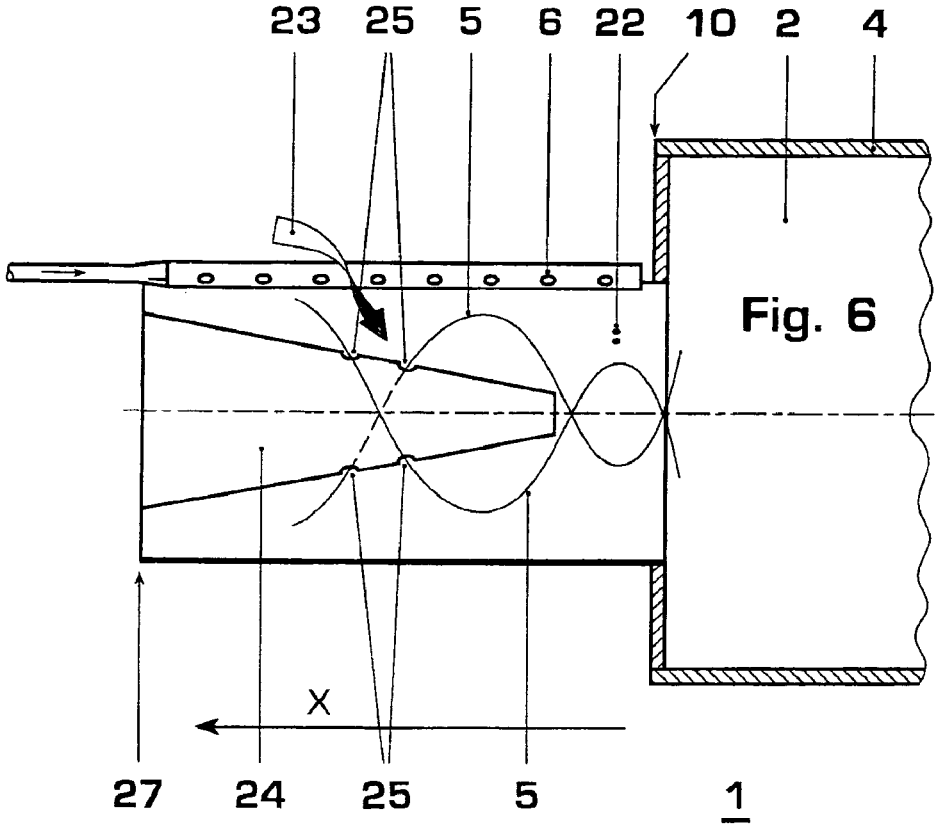
FIG. 6 shows a first embodiment of a further burner with central means according to the invention for injecting fuel.
Figure 7:
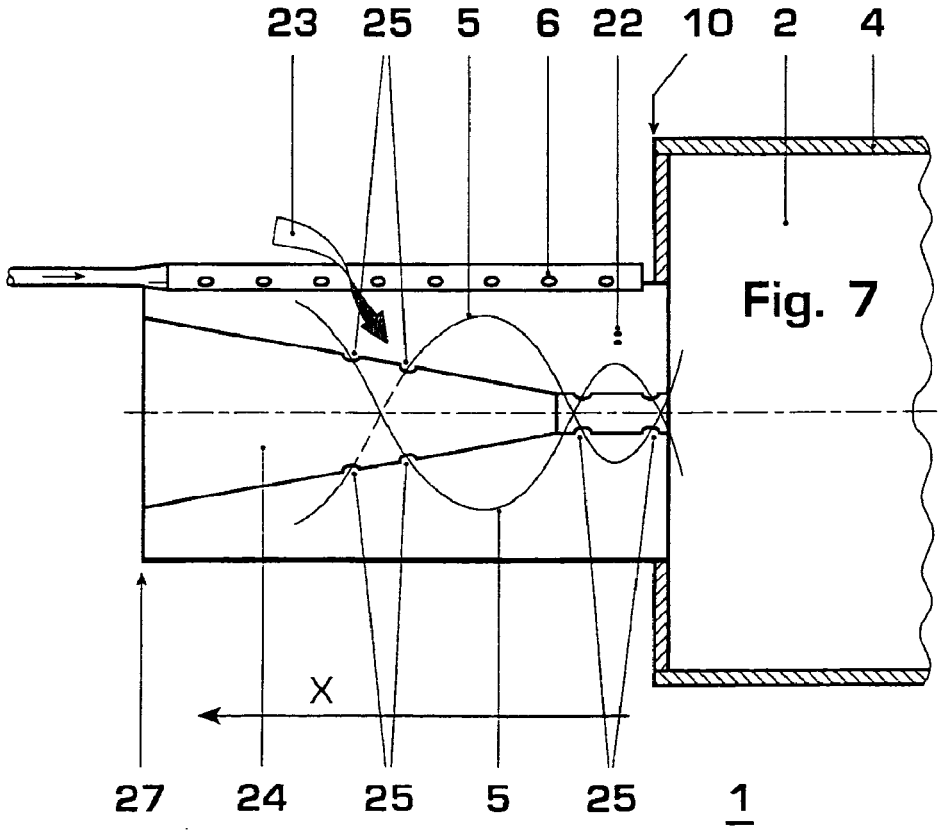
FIG. 7 shows a second embodiment of a further burner with central means according to the invention for injecting fuel.

It is advantageous for the fuel lance 24 simultaneously to be used as a pilot lance, i.e. the fuel lance 24 also has the possibility of generating a diffusion flame as close as possible to the flame position present in premix operation for pilot operation in the lower load range. Alternatively, it is possible to use a lance which is intended for oil operation of the premix burner. By way of example, a lengthened pilot lance, as described, for example, in EP-A2 0 788 445 for the case of a double-cone burner, in WO 93/17279 for the case of an inverted double-cone burner with a cylindrical outer shape, and in EP-A2 0 833 105 for the case of an inverted double-cone burner with a cylindrical outer shape and downstream mixing section, can also be used. Two different exemplary embodiments of an inverted double-cone burner in accordance with the present invention are illustrated in FIGS. 6 and 7. With regard to the geometry and dimensioning of a pilot lance of this nature, in particular the content of disclosure of EP-A2 0 788 445 is explicitly incorporated in the present application.

The fuel lance 24 is advantageously designed in the form of nested, concentric cylindrical tubes, with the pilot fuel (gaseous or liquid) or the oil fuel, in the case of pilot operation or oil operation, respectively, flowing in the central tube, which has the smallest diameter, while the fuel for injection via the fuel injection holes 25 is supplied in the space between the outermost tube and the next tube in. It is also possible for the individual fuel injection holes 25 to be divided into individually actuable groups in order if appropriate to allow the operating conditions of the premix burner and the distribution 12 to be set and controlled variably.

Figure 5:
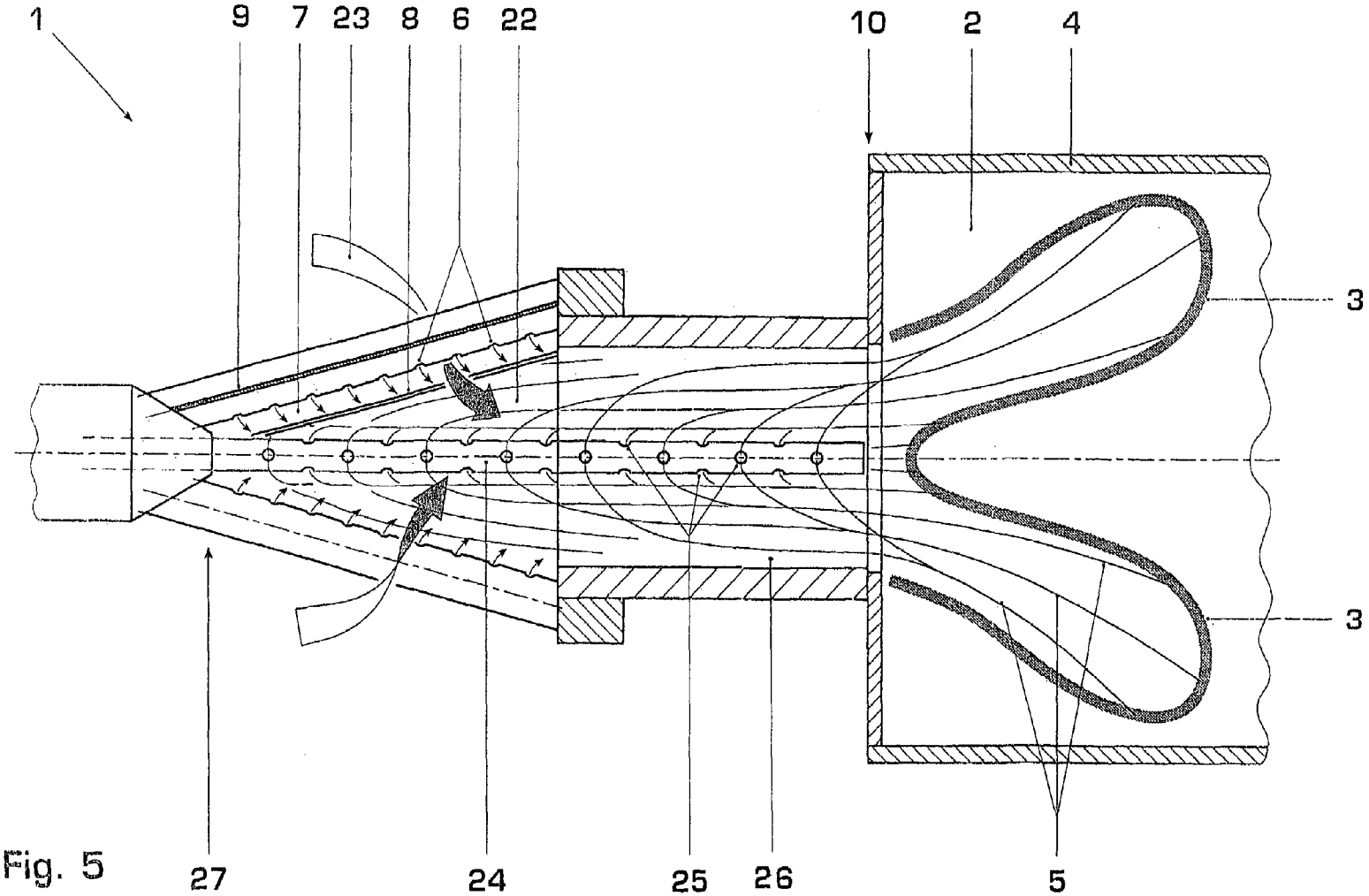
FIG. 5 shows a four-slot burner with downstream mixing section and with means for injecting fuel arranged in the interior space of the burner.

A further exemplary embodiment is illustrated in FIG. 5. This is a four-slot burner, i.e. a premix burner which has four conical elements and therefore four air inlet slots 7. Moreover, the burner has a downstream mixing section 26 which is cylindrical in form and, moreover, has transition passages, which are not shown in FIG. 5 and run in the direction of flow. A burner of this type is presented, for example, in EP-A2 0 704 657 and EP-A2 0 780 629. A similar problem also arises in burners of this nature, namely that the delay time scatter in the injection of fuel via the fuel nozzles 6 is small in relation to the maximum value $\tau_{max}$. In this case, the fuel lance 24 advantageously projects into the burner not only over the length of the conical section but also well into the mixing passage 26. In principle, in this case too it is desirable for the fuel lance to be made so long that at least a time delay $\Delta\tau$ which reaches or exceeds half the maximum value is reached, i.e. $\Delta\tau\geqq 0.5\ \tau_{max}$. This means that the lance 24 should be of a length which corresponds to at least half the length of the conical part + mixing section 26. On account of the considerable length of the fuel lance 24, the delay time scatter can be varied within a wide range, which allows a stable burner performance over a wider operating range.

LIST OF DESIGNATIONS

1 Double cone burner
2 Combustion space
3 Flame front
4 Wall of the combustion space

5 Flow lines of the fuel/air mix
6 Fuel nozzles
7 Gap between the conical burner shells
8 Inner conical burner shell at 7
9 Outer conical burner shell at 7
10 Front end of the double-cone burner
11 Constant time delay
12 Time delay distribution
13 Unstable region with high delay times
14 Stabilizing shift toward large distribution widths
15 Stabilizing shift toward short delay times
16 Unstable region of short delay times
17 Performance at low flow velocity
18 Performance at medium flow velocity
19 Performance at high flow velocity
21 Time delay range which can be set
22 Interior space
23 Combustion air stream
24 Pilot lance
25 Holes in pilot lance, fuel injection holes
26 Downstream mixing section
27 Burner base While the invention has been described in detail with reference to preferred embodiments thereof, it will be apparent to one skilled in the art that various changes can be made, and equivalents employed, without departing from the scope of the invention. Each of the aforementioned documents is incorporated by reference herein in its entirety.

What is claimed is:

1. A burner comprising:

at least one burner shell, wherein said at least one burner shell comprises at least two hollow part-cone bodies positioned with respect to one another to have an increasing cone inclination in a direction of flow, at least one gap therebetween, and are arranged offset with respect to one another so that combustion air flows into the interior space though the at least one gap between the part-cone bodies;

fuel nozzles arranged in the at least one burner shell;

an interior space surrounded by said at least one burner shell, the interior space configured and arranged for burner fuel to be injected though said fuel nozzles into a combustion air stream when flowing within the interior space, and a fuel/air mix when formed to flow, within a delay time ($\tau$), to a flame front in a combustion chamber, where said fuel/air mix can be ignited;

a burner base;

a fuel lance having at least two fuel injection holes distributed over a length of said fuel lance, the fuel lance projecting from the burner base into the interior space substantially in the direction of the combustion chamber, though which fuel injection holes a fuel can be injected into the combustion air stream in such a manner that the delay time ($\tau$) between the injection of the fuel and combustion of said fuel at the flame front is different for the at least two fuel injection holes;

wherein the fuel lance is substantially cylindrical in cross section, with the at least two fuel injection holes being distributed both with regard to the length of the fuel lance and with regard to their circumferential arrangement on the fuel lance; and wherein the fuel lance comprises a central tube projecting into the interior space and including tubes which are nested coaxially inside one another, wherein pilot fuel can be supplied via a tube of said central tube having the smallest diameter, and wherein the fuel to be injected into the interior space though said fuel injection holes can be supplied via the space between the tube having the largest diameter and an adjacent tube of said central tube.

2. The burner as claimed in claim 1, wherein the fuel lance is arranged substantially on an axis of the burner.

3. The burner as claimed in claim 1, wherein the burner includes a burner end, and wherein the fuel can be injected in such a manner that the time delay distribution decreases over a burner length (x) from the burner base to the burner end, starting from a maximum time delay value $\tau_{max}$, decreasing by a maximum time delay difference ($\Delta\tau$), to a minimum value at the burner end of $\tau_{max}-\Delta\tau$.

4. The burner as claimed in claim 1, wherein the fuel lance is configured and arranged to inject fuel into different flow lines within the burner though different fuel injection holes.

5. The burner as claimed in claim 1, wherein the fuel lance comprises a portion the length of which projects into the interior space in the range from half the length to the full length of a premix section of the burner.

6. The burner as claimed in claim 1, wherein the at least one gap comprises four slots.

7. The burner as claimed in claim 1, wherein the at least two fuel injection holes are divided into groups, with one group of fuel injection holes being arranged so that all the nozzles belonging to said one group feed a defined region of the flame front, with a differing time delay ($\Delta$).

8. The burner as claimed in claim 1, wherein the fuel lance comprises an even plurality of fuel injection holes.

9. The burner as claimed in claim 1, wherein the fuel lance comprises said at least two fuel injection holes, said at least two fuel injection holes formed on a surface of the fuel lance.

10. The burner as claimed in claim 1, wherein the at least one burner shell defines a cone burner.

11. The burner as claimed in claim 1, wherein the at least one burner defines a double-cone burner.

12. The burner as claimed in claim 6, further comprising: a mixing section arranged downstream of the burner.

13. The burner as claimed in claim 8, wherein the even plurality of fuel injection holes are divided into groups of two nozzles each, said groups configured and arranged to be individually actuated.

14. The burner as claimed in claim 1, further comprising: a pilot nozzle arranged at the tip of the fuel lance.

15. A burner comprising:

at least one burner shell;

fuel nozzles arranged in the at least one burner shell;

an interior space surrounded by said at least one burner shell, the interior space configured and arranged for burner fuel to be injected though said fuel nozzles into a combustion air stream when flowing within the interior space, and a fuel/air mix when formed to flow, within a delay time ($\tau$), to a flame front in a combustion chamber, where said fuel/air mix can be ignited;

a burner base;

a fuel lance having at least two fuel injection holes distributed over a length of said fuel lance, the fuel lance projecting from the burner base into the interior space substantially in the direction of the combustion chamber, though which fuel injection holes a fuel can be injected into the combustion air stream in such a manner that the delay time ($\tau$) between the injection of the fuel and combustion of said fuel at the flame front is different for the at least two fuel injection holes; and wherein the fuel lance comprises a central tube which projects into the interior space and is formed from tubes which are nested coaxially inside one another, wherein pilot fuel can be supplied via a tube of the central tube having the smallest diameter and wherein the fuel to be injected into the interior space though said fuel injection holes is supplied via a space between a tube of the central tube having the largest diameter and an adjacent tube of the central tube.

16. A method for feeding fuel into a burner, which burner includes an interior space surrounded by at least one shell, the method comprising:

injecting fuel though fuel nozzles into a combustion air stream flowing within the interior space, and forming a fuel/air mix;

flowing the fuel/air mix, within a delay time ($\tau$), to a flame front in a combustion chamber;

igniting the fuel/air mix at the flame front;

wherein injecting comprises injecting the fuel at least in part into the combustion air stream via at least two fuel injection holes distributed over the length of a fuel lance projecting from a burner base into the interior space substantially in the direction of the combustion chamber, so that the delay time ($\tau$) between the injection of the fuel and combustion of said fuel at the flame front differs between the fuel injection holes;

wherein the fuel lance comprises a central tube, which projects into the interior space and is formed from tubes which are nested coaxially inside one another;

wherein for pilot operation of the burner, pilot fuel is supplied via a tube of said central tube having the smallest diameter; and wherein for premix operation of the burner, fuel to be injected into the interior space though said fuel injection holes is supplied via the space between the tube having the largest diameter and an adjacent tube of said central tube.

17. The method according to claim 16, wherein injecting comprises injecting the fuel at least in part into the combustion air stream via a plurality of fuel injection holes distributed over the length of said means.

18. The method as claimed in claim 16, wherein injecting comprises injecting fuel into different flow lines within the burner though different fuel injection holes.

19. The method as claimed in claim 16, wherein injecting comprises injecting the fuel so that the time delay distribution is configured to decrease over the burner length (x) from the burner base to the burner end from a maximum value $\tau_{max}$, decreasing by a maximum delay difference ($\Delta\tau$), to a minimum value at the burner end (10) of $\tau_{max}-\Delta\tau$.

20. The method as claimed in claim 19, wherein injecting comprises injecting the fuel so that the time delay distribution over the burner length is configured to decrease substantially linearly toward the burner end from the maximum value $\tau_{max}$, decreasing by a maximum delay difference ($\Delta\tau$), to a minimum value at the burner end (10) of $\tau max-\Delta\tau$.

21. The method as claimed in claim 16, wherein the delay difference ($\Delta\tau$) is in the range from 10-90% of the maximum value ($\tau_{max}$).

22. The method as claimed in claim 21, wherein the delay difference ($\Delta\tau$) is more than 50% of the maximum value ($\tau_{max}$).

* * * * *